US005680931A

United States Patent [19]

Hashimoto et al.

[11] Patent Number: 5,680,931

[45] Date of Patent: Oct. 28, 1997

[54] OUTBOARD MOTOR PACKING STRUCTURE CONVERTIBLE TO DISPLAY STAND

[75] Inventors: Gaku Hashimoto; Touru Matsushita, both of Hamamatsu, Japan

[73] Assignee: Sanshin Kogyo Kabushiki Kaisha, Hamamatsu, Japan

[21] Appl. No.: 641,065

[22] Filed: Apr. 29, 1996

[30] Foreign Application Priority Data

Apr. 28, 1995 [JP] Japan ..... 7-105336

[51] Int. Cl.[6] ..... B65D 85/68

[52] U.S. Cl. ..... 206/319; 248/640; 248/643; 410/2

[58] Field of Search ..... 206/319, 320; 217/36; 248/641, 642, 643, 640; 211/13, 194; 410/2, 31, 32; 280/DIG. 2

[56] References Cited

U.S. PATENT DOCUMENTS

| | | | |
|---|---|---|---|
| 2,249,270 | 7/1941 | Boeye | 206/319 |
| 2,266,683 | 12/1941 | Berglund | 248/640 |
| 2,515,428 | 7/1950 | Scott et al. | 206/319 |
| 2,575,749 | 11/1951 | Cross | 206/319 |
| 2,686,028 | 8/1954 | Johnson | 206/319 |
| 2,764,381 | 9/1956 | Anderson | 248/643 |
| 2,843,393 | 7/1958 | Dahlander, Sr. | 248/643 |
| 4,153,159 | 5/1979 | Smith, Jr. | 206/319 |
| 5,427,237 | 6/1995 | Kiefer et al. | 206/320 |
| 5,439,152 | 8/1995 | Campbell | 211/195 |

*Primary Examiner*—David T. Fidei

*Attorney, Agent, or Firm*—Knobbe, Martens, Olson & Bear LLP

[57] ABSTRACT

An outboard motor packing structure convertible to a display stand, having a rectangular parallelepiped formed with rod members, which rod members include first side rods on both right and left sides connecting the front and back rods, in which an end of each first side rod is detached from the front rods and connected to the bottom rods when the packing structure accommodating an outboard motor therein is converted to a display stand by disjointing parts of the rods, wherein the outboard motor is in the same position as when installed in a boat.

6 Claims, 7 Drawing Sheets

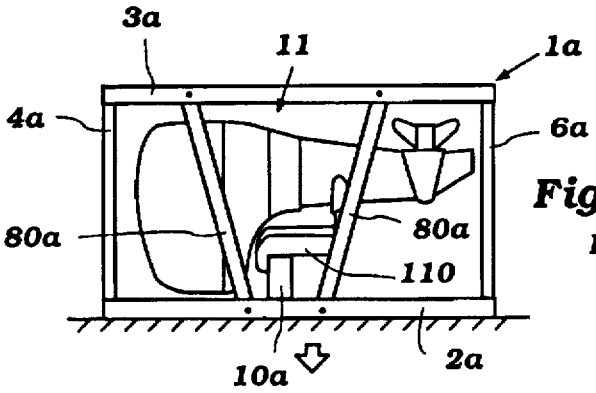
Figure 7A
Prior Art
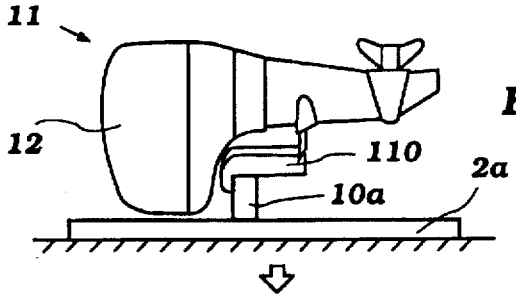
Figure 7B
Prior Art
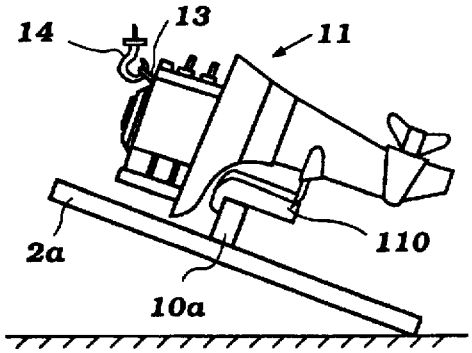
Figure 7C
Prior Art
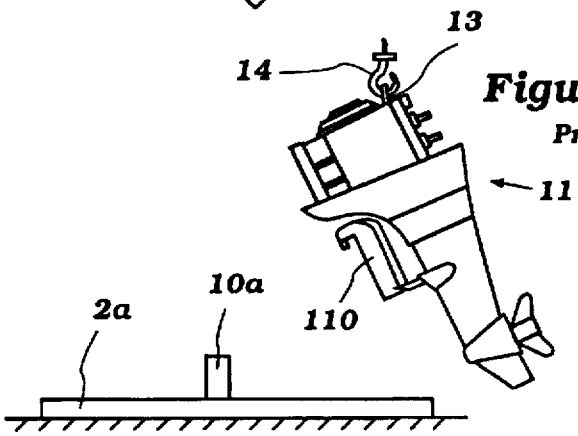
Figure 7D
Prior Art
Figure 7
Prior Art

OUTBOARD MOTOR PACKING STRUCTURE CONVERTIBLE TO DISPLAY STAND

BACKGROUND

1. Field of the Invention

This invention relates to an outboard motor packing structure convertible to a display stand for exhibition, and in particular, to such a packing structure provided with pivotable rod members on the sides, which structure allows for easy conversion to a display stand when displayed for exhibition, and allows for simplification of the work of detaching the outboard motor from the display stand.

2. Background of the Art

Heretofore, as a packing structure (a packing box frame) for an outboard motor, a structure is used which has an interior of a rectangular parallelepiped formed with a rod member such as L-shaped structural steel, in which an outboard motor is accommodated. After transporting the outboard motor packed in the packing structure to a given destination, the packing structure is disjointed, and the outboard motor is taken out. When the outboard motor is displayed, a special stand provided with a latching member is used to accommodate a crank bracket of the outboard motor therein so as to set the outboard motor in a horizontal position as if it is installed at the stem of a boat.

In the above, to take the outboard motor out of the packing structure, the packing structure is disjointed in the manner shown in FIGS. 7A through 7D. That is, as shown in FIG. 7A, a packing structure 1 a is composed of paired lower horizontal parallel members 2*a*, paired upper horizontal parallel members 3*a*, paired edge connecting members 4*a* and 6*a* for connecting the lower horizontal parallel members 2*a* and the upper horizontal parallel members 3*a* at the edges thereof, paired side members 80*a* for connecting the lower horizontal parallel members 2*a* and the upper horizontal parallel members 3*a* at the sides thereof, and a latching member 10a straddling the lower horizontal parallel members 2*a*. An outboard motor 11 is attached to the packing structure by fixing a crank bracket 110 of the outboard motor to the latching member 10*a*. After the packing structure 1*a* is transported to a given destination, the packing structure 1*a* is horizontally placed with the crank bracket 110 down. From this position, the upper horizontal parallel members 3*a*, the edge connecting members 4*a* and 6*a*, and the side connecting members 80*a* of the packing structure 1*a* are taken off by unscrewing their respective bolts as shown in FIG. 7B. A cowling 12 of the outboard motor 11 is then taken off, and a hook 14 of a lifting device (not shown) is latched to a hook 13 provided in the head of the outboard motor 11, and lifts the outboard motor 11, as shown in FIG. 7C. At this time, the latching member 10*a* and the lower horizontal parallel members 2*a* are also lifted with the outboard motor 11, because the latching member 10*a* has a U-shaped upper portion which catches the crank bracket 110 and is fitted thereto. The outboard motor 11 is further lifted while holding the upper horizontal parallel members 2*a* with an appropriate means. The crank bracket 110 is then detached from the latching member 10*a* as shown in FIG. 7D. After taking the outboard motor 11 from the packing structure 1*a*, the outboard motor 11 is attached to an appropriate display stand for exhibition.

As described above, heretofore, the unpacking processes of the outboard motor 11 is troublesome and time-consuming. Further, the outboard motor 11 needs a display stand for exhibition, and fixing the outboard motor to the display stand is also troublesome and time-consuming. As a result, transporting and displaying an outboard motor is very costly.

SUMMARY OF THE INVENTION

The present invention has exploited structures for a packing structure and a display stand which render processes of unpacking and display easy and simple. An objective of the present invention is to provide an outboard motor packing structure convertible to a display stand, which eliminates the use of a separate display stand and simplifies unpacking and displaying processes, without substantially increasing the number of parts constituting the structure.

Namely, one important aspect of the present invention is an outboard motor packing structure convertible to a display stand, having an interior for accommodating an outboard motor, said interior formed in a rectangular parallelepiped formed with rod members, said rod members comprising: paired parallel front members, each having a top end and a bottom end; paired parallel back members, each having a top end and a bottom end; top connecting members for connecting said top ends of said paired parallel front members and said paired parallel back members; bottom connecting members for connecting said bottom ends of said paired parallel front members and said paired parallel back members; a latching member for fastening a crank bracket of the outboard motor therein, said latching member perpendicularly bridging said paired parallel back members; a first fight-side connecting member having first and second ends for connecting one of said paired parallel back members at said first end and one of said respective paired parallel front members at said second end on the right side, said second end being detachable from said one of said paired parallel front members, wherein said side connecting member is pivotable at said first end, and said second end is fixedly connectable to one of said bottom connecting members on the right side; and a first left-side connecting member having first and second ends for connecting one of said paired parallel back members at said first end and one of said respective paired parallel front members at said second end on the left side, said second end being detachable from said one of said paired parallel front members, wherein said side connecting member is pivotable on said first end, and said second end is fixedly connectable to one of said bottom connecting members on the left side, wherein said rod members are coordinated in such a way that when the outboard motor is accommodated in the interior of said packing structure, the crank bracket of the outboard motor is latched onto said latching member, the top of the outboard motor faces said top connecting members, and said packing structure can be set up with the bottom connecting members down. In the above, the top, bottom, front, back, right side, and left side are defined based on the positions when an outboard motor accommodated in the structure is displayed. By using the side connecting members removable and connectable to the bottom members, the packing structure can be converted to a display stand simply by disjointing parts of the rod members and setting the packing structure upright, thereby eliminating the use of a separate display stand for exhibition and the work of unpacking the outboard motor and attaching it to a display stand, and further simplifying the work of detaching the outboard motor from the packing structure by simply lifting the outboard motor straight from the position when the packing structure is set up with the bottom members down.

The above outboard motor packing structure convertible to a display stand preferably further comprises: a second right-side connecting member having first and second ends for connecting one of said paired parallel back members at said first end and one of said respective paired parallel front members at said second end on the right side, said second right-side connecting member and said first right-side connecting member being positioned in such a way that the distance between said second end of said first right-side connecting members and said second end of said second right-side connecting member is greater than the distance between said first end of said first right-side connecting members and said first end of said second right-side connecting member; and a second left-side connecting member having first and second ends for connecting one of said paired parallel back members at said first end and one of said respective paired parallel front members at said second end on the left side, said second left-side connecting member and said first left-side connecting member being positioned in such a way that the distance between said second end of said first left-side connecting members and said second end of said second left-side connecting member is greater than the distance between said first end of said first left-side connecting members and said first end of said second left-side connecting member. By using the second side connecting member positioned in such a way that the distance between the first and second side connecting members is widened toward the second ends in the front connecting members, it is possible to efficiently distribute the load, thereby improving strength of the packing structure without increasing its weight, and thus it is possible to stack a packing structure with an outboard motor on top of another packing structure with an outboard motor.

The above outboard motor packing structure convertible to a display stand preferably further comprises a fastening belt for fastening a lower end of the outboard motor, said belt being attached to at least one of said bottom connecting members, connecting said bottom ends of said paired parallel back members. By using the latching member in combination with the fastening belt, it is possible to easily and securely accommodate an outboard motor in the packing structure.

Further, in a preferable embodiment of the above outboard motor packing structure convertible to a display stand 1, the top connecting members are comprised of two parallel pairs of members perpendicular to each other, and said bottom connecting members are comprised of two parallel pairs of members perpendicular to each other. In addition, the latching member is preferably positioned in such a way that when the outboard motor is accommodated in the interior of said packing structure, the outboard motor is set up vertically when said structure is set up with said bottom connecting members down.

The present invention is adapted to be embodied in packing structures for various types of outboard motors.

BRIEF DESCRIPTION OF THE FIGURES

FIG. 6 is schematic side views showing the processes of detaching an outboard motor from a display stand converted from a packing structure according to the present invention, in which FIG. 6A shows a connecting process of a hook of a lifting device, FIG. 6B shows the commencement of lifting, and FIG. 6C shows a detaching process of the outboard motor from the display stand. FIG. 7 is schematic side views showing the processes of detaching an outboard motor from a packing structure of the prior art, in which FIG. 7A shows a packing structure storing an outboard motor, FIG. 7B shows a packing structure storing an outboard motor when rod members ends are disjoined, FIG. 7C shows the commencement of lifting, and FIG. 7D shows a detaching process of the outboard motor from the display stand.

DETAILED DESCRIPTION OF THE PREFERRED EMBODIMENT

Referring now in detail to the drawings, an outboard motor packing structure is shown. The invention is shown in conjunction with an example of an outboard motor and an example of rod member material. However, the invention can be embodied in conjunction with other types of outboard motors and other types of material (steel, various alloys, or the like formed in an L-shaped rod, hollow pipe, plate, or the like). Those skilled in the art can readily understand how the invention can be utilized with any known type of outboard motors.

Structures of Packing Structure

Figure 1:
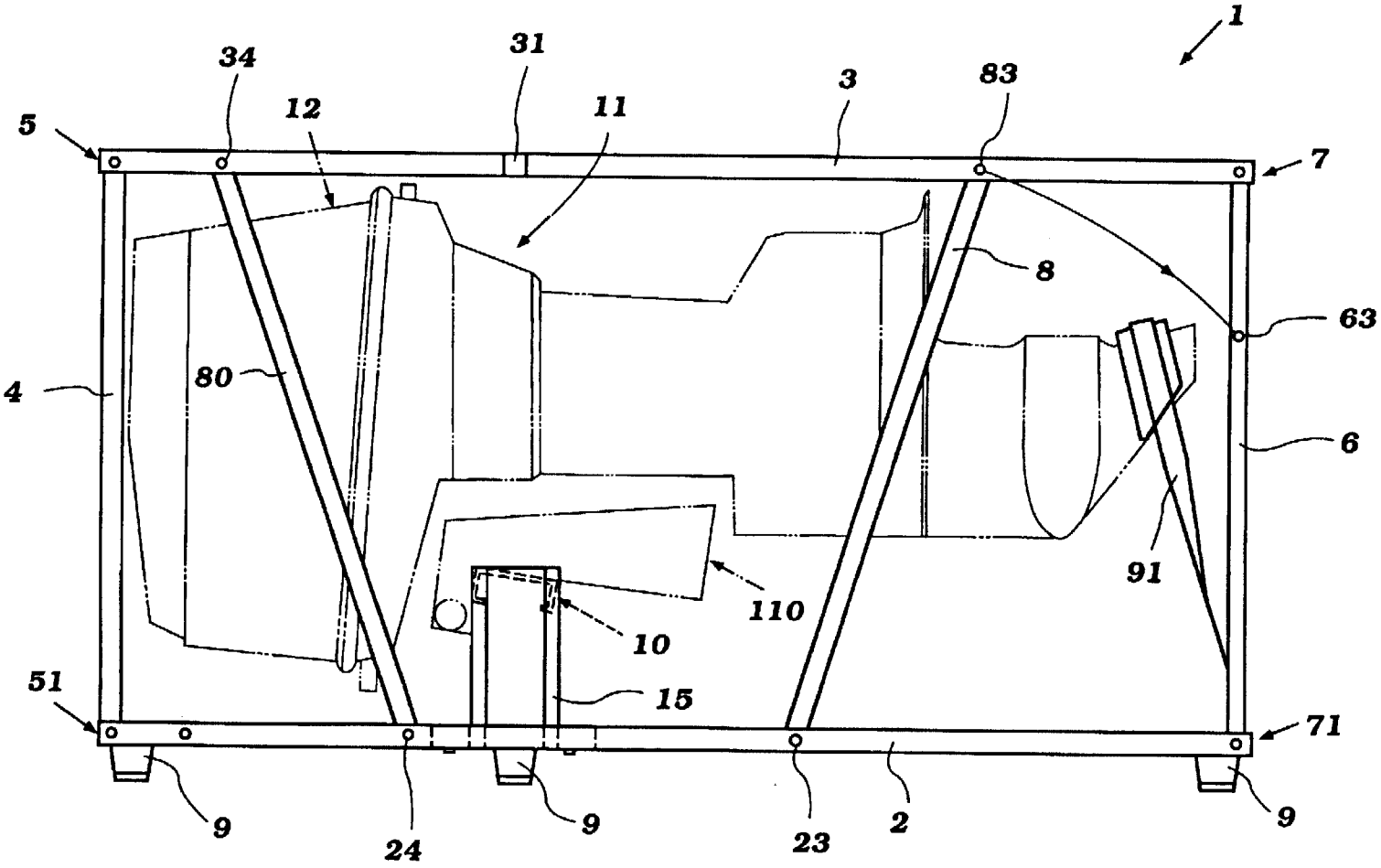
FIG. 1 is a schematic side elevational view showing an outboard motor packing structure convertible to a display stand according to an embodiment of the present invention.
Figure 2:
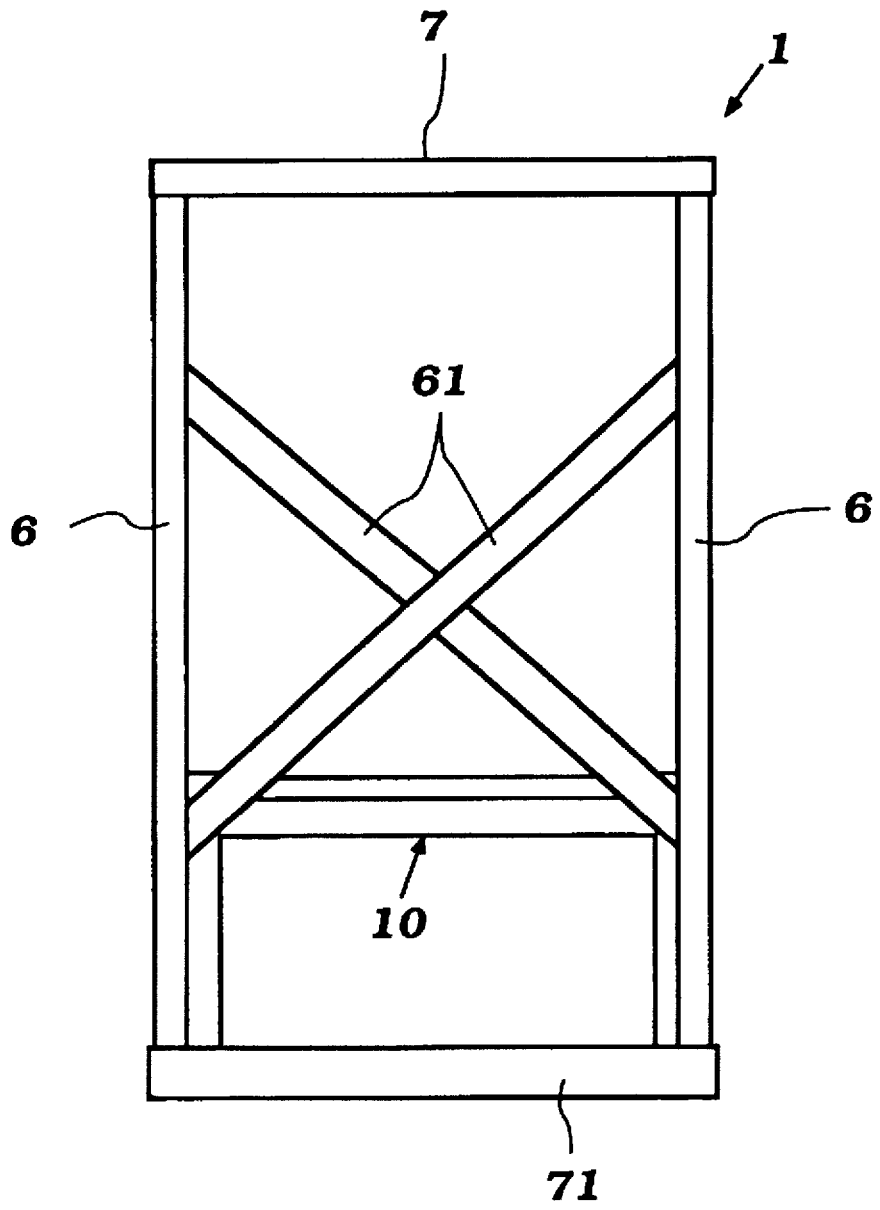
FIG. 2 is a schematic end view from the bottom of an outboard motor packing structure convertible to a display stand according to an embodiment of the present invention.
Figure 3:
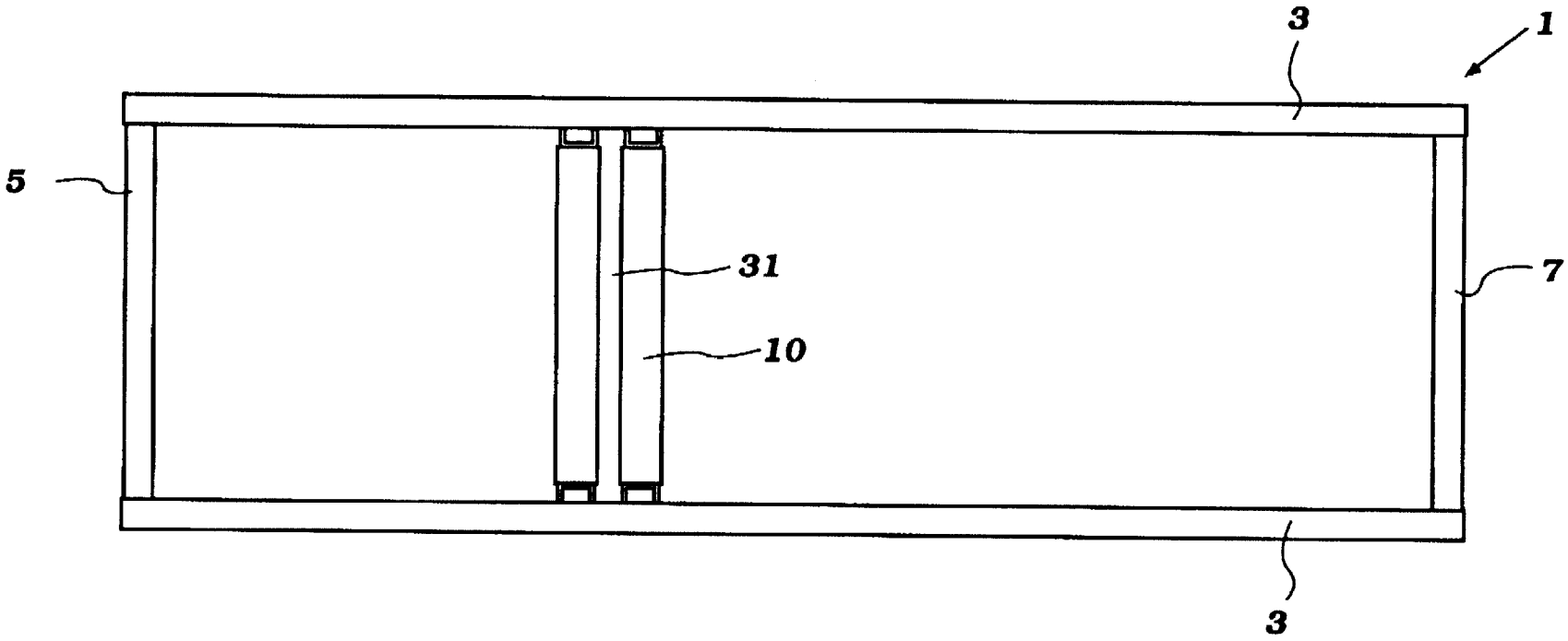
FIG. 3 is a schematic plane view of an outboard motor packing structure convertible to a display stand according to an embodiment of the present invention.

FIGS. 1–3 show an outboard motor packing structure convertible to a display stand according to an embodiment of the present invention. As shown in FIG. 1 which is a schematic side elevational view, an outboard motor packing structure 1 has an interior for accommodating an outboard motor 11, which interior is formed in a rectangular parallelepiped formed with rod members such as L-shaped structural steel. Hereinafter, "top", "bottom", "front", "back", "right side", and "left side" are defined based on the positions when an outboard motor accommodated in the structure is displayed. The packing structure is comprised of: paired parallel back connecting members 2, each having a top end and a bottom end; paired parallel front connecting members 3, each having a top end and a bottom end; and end connecting members comprised of top connecting members for connecting the top ends of the paired parallel front connecting members and the paired parallel back connecting members, and bottom connecting members for connecting the bottom ends of the paired parallel front connecting members and the paired parallel back connecting members. The top connecting members are comprised of a top horizontal connecting member 5 for connecting the top ends of the paired parallel front connecting members 3, a top horizontal connecting member 51 for connecting the top ends of the paired parallel back connecting members 2, and top side parallel connecting members 4 for connecting the top ends of the paired parallel front connecting members 3 and the respective top ends of the paired parallel back connecting members 2. The bottom connecting members are comprised of a bottom horizontal connecting member 7 for connecting the bottom ends of the paired parallel front connecting members 3, a bottom horizontal connecting member 71 for connecting the bottom ends of the paired parallel back connecting members 2, and bottom side parallel connecting members 6 for connecting the bottom ends of the paired parallel front connecting members 3 and the respective bottom ends of the paired parallel back connecting members 2.

In addition, as shown in FIG. 2 which is a schematic end view from the bottom of an outboard motor packing structure, two middle connecting members 61 intersecting each other are provided to connect the bottom side parallel connecting members 6. Further, as shown in FIG. 3 which is a schematic plane view of an outboard motor packing structure, as well as in FIG. 1, a middle connecting member 31 is provided to connect the paired parallel front connecting members 3.

To the paired parallel back connecting members 2, a latching member 10 perpendicularly bridging the paired parallel back connecting members 2 is fixed by support members 15 to fasten a crank bracket 110 outboard outboard motor 11 when the outboard motor is accommodated. The top horizontal connecting member 5, the top horizontal connecting member 51, the top side parallel connecting members 4, the 30 bottom horizontal connecting member 7, the bottom horizontal connecting member 71, and the bottom side parallel connecting members 6 are removably fixed to the respective rod members using bolts. Feet 9 for the packing structure 1 are attached to the undersides of the paired parallel back connecting members 2 at midsection and both ends, so that the paired parallel back connecting members 2 are not touching the ground when the packing structure 1 is positioned with the paired parallel back connecting members 2 down.

On the right side of the packing structure 1, a first right-side connecting member 8 having first and second ends and a second right-side connecting member 80 having first and second ends are provided to connect one of the paired parallel back connecting members 2 at said first ends and one of the respective paired parallel front connecting members 3 at said second ends. The first and second right-side connecting members 8 and 80 are removably attached to the parallel front and back connecting members 3 and 2 with bolts 83, 23, 34, and 24. The first right-side connecting member 8, which is closer to the parallel bottom connecting members 6 than is the second right-side connecting member 80, is pivotable at the first end thereof after detaching the second end thereof from the one of the paired parallel front connecting members 3 by unscrewing the bolt 83. The second end of the first right-side connecting member 8 can be then fixed to one of the paired parallel bottom connecting members 6 with bolt 63. In this way, the positional relationship between the one of the paired parallel bottom connecting members 6 and the respective paired parallel back connecting members 2 can be secured. Side connecting members 8 and 80 on the left side of the packing structure are attached and function in the same way as those on the right side.

In the interior of the packing structure 1, the crank bracket 110 of the outboard motor 11 can be latched onto the latch member 10 in such a way that the outboard motor 11 with a cowling 12 is horizontally positioned when placed on the horizontal front connecting members 2 (vertical in the display position), in which a lower part of the outboard motor 11 is firmly secured with a fastening belt 91 which pulls the lower parts in association with the latch member 10. In this structure, the weight of the outboard motor 11 is exerted onto the paired parallel back connecting members 2 via the latch member 10 through the support 15. The foot 9 at the midsection is positioned under the latch member 10 and between the first ends of the first and second side connecting members 8 and 80 (both left and right sides), and the distance between the first and second side connecting members 8 and 80 are widened towards their second ends on the paired parallel front connecting members 3. With the above structure, the weight of the outboard motor 11 is distributed through the latch member 10 to the paired parallel bottom connecting members 2 and further to the paired parallel top connecting members 3 via the side connecting members 8 and 80, thereby improving the strength of the structure, and allowing for stacking a packing structure with an outboard motor on another packing structure with an outboard motor.

Conversion to Display Stand

Figure 4:
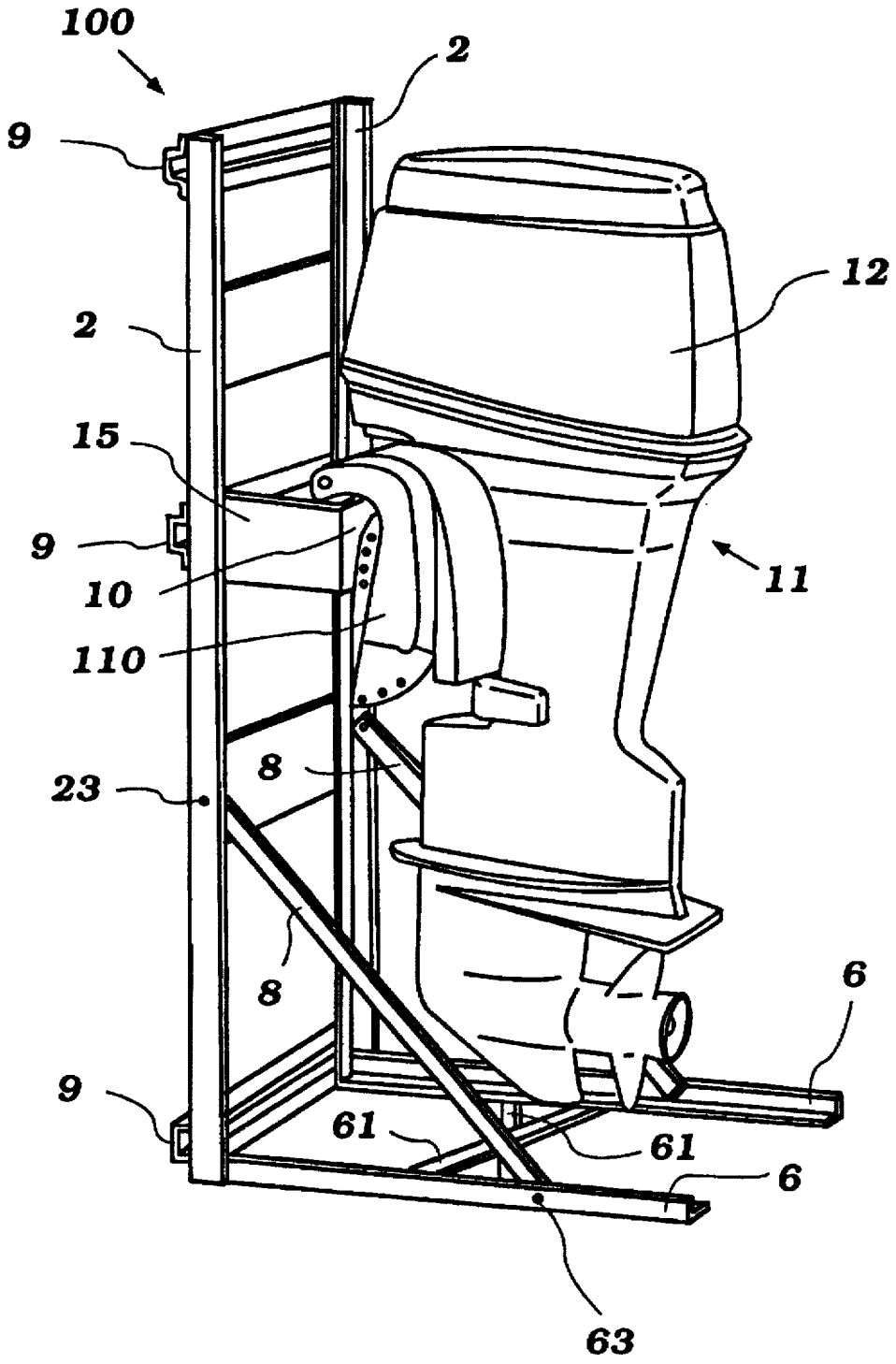
FIG. 4 is a schematic prospective view showing an outboard motor packing structure convertible to a display stand, which is converted to a display stand wherein an outboard motor is accommodated, according to an embodiment of the present invention.
Figure 5:
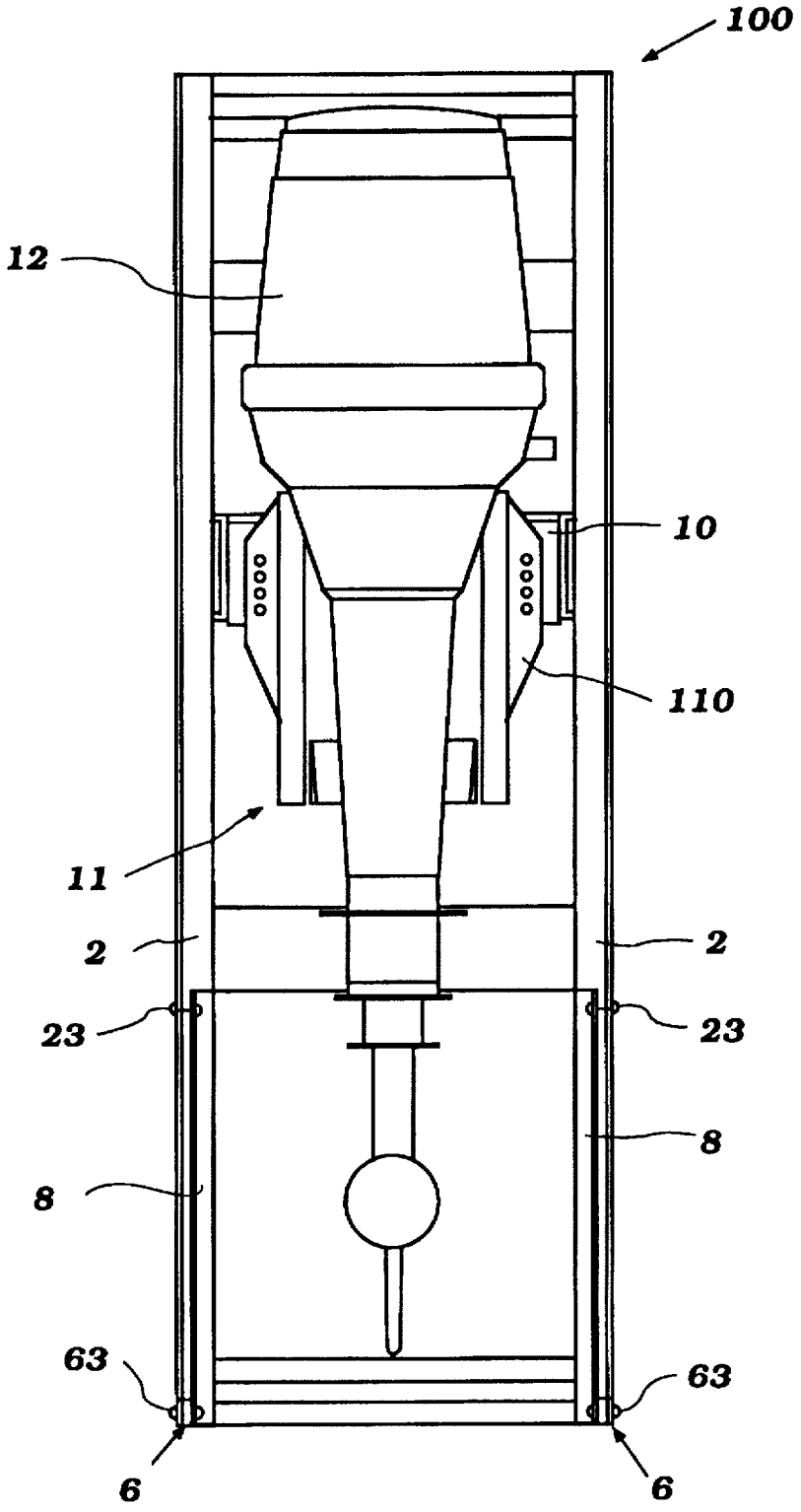
FIG. 5 is a schematic elevational view showing the display stand converted from a packing structure with an outboard motor shown in FIG. 4.

The packing structure 1 accommodating the outboard motor 11 therein is transported to a given place, and horizontally placed on the ground as shown in FIG. 1. The top horizontal connecting member 5, the top side parallel connecting members 4, the bottom horizontal connecting member 7, the paired parallel front connecting members 3, and the second side connecting members 80 (both right and left sides) are removed. After detaching the second ends of the first side connecting members 8 (both right and left sides) from the paired parallel from connecting members 3 by unscrewing the bolts 83, the first side connecting members 8 are pivoted at the first ends. The second ends of the first side connecting members 8 (both right and left sides) are then fixed to the respective paired parallel bottom connecting members 6 with bolts 63. When the packing structure 1 is set up with the bottom connecting members 6 down, in which the bottom connecting members 6 are secured to or close to the ground, a display stand 100 is formed wherein the outboard motor 11 is in the same position as when installed in a boat, as shown in FIGS. 4 and 5. The display stand 100 can be used for exhibition as is.

In the above, the side connecting member 8 is positioned at a slant between the respective paired parallel front connecting members 3 and the respective paired parallel back connecting members 2, i.e., the second end of the side connecting member 8 is closer to the bottom connecting members 6 than is the first end thereof, making small the rotation angle of the side connecting member 8 on the first end to attach the second end thereof to the respective bottom connecting members 6. Thus, the work of changing the position of the side connecting member 80 is easy.

Figures 6, 6A, 6B, 6C:
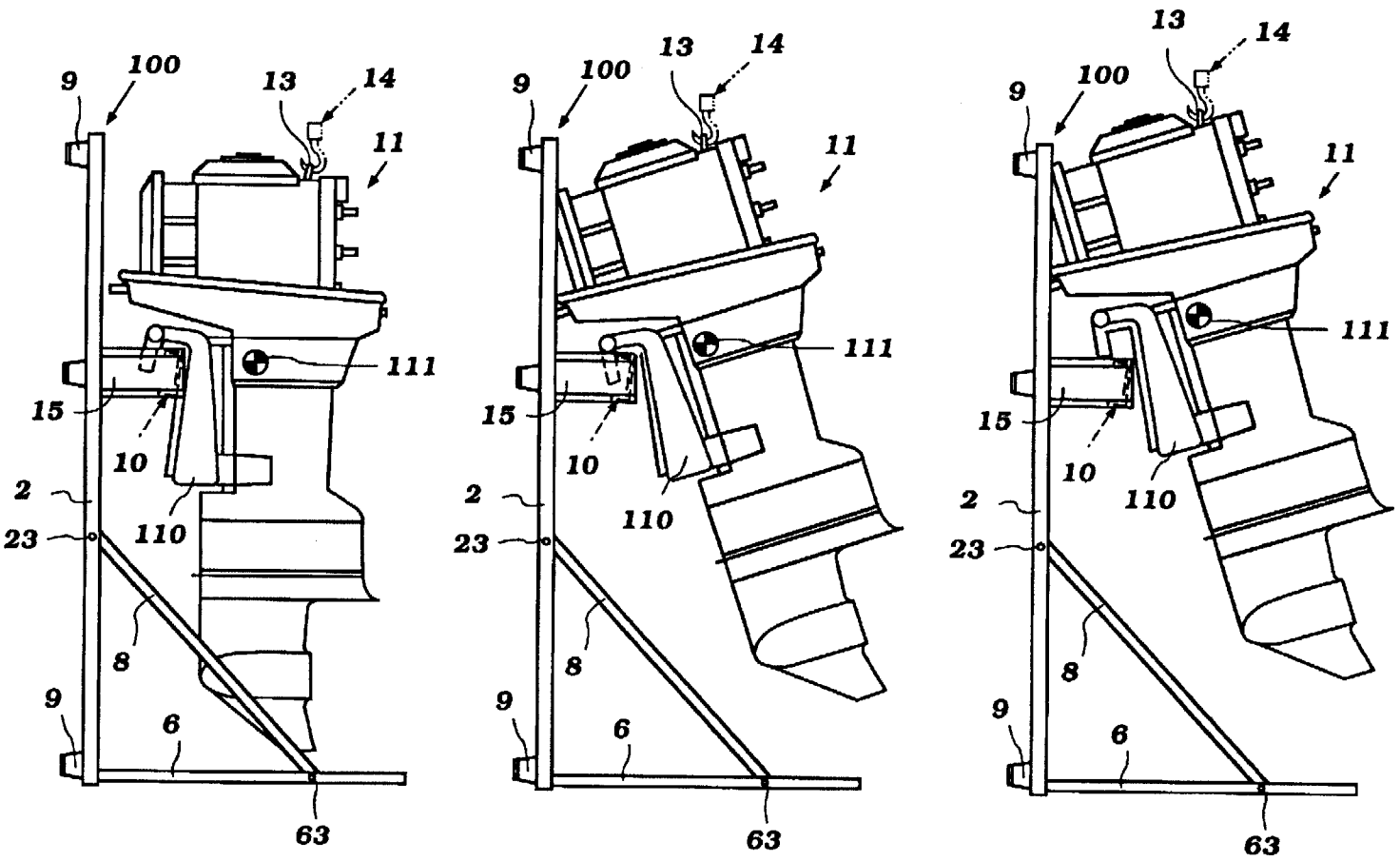

In the display stand 100, the weight of the outboard motor 11 is exerted on the support 15 which supports the latch member 10 and which is attached to the paired parallel back connecting members 2, and the twisting moment is exerted clockwise onto the paired parallel back connecting members 2. The side connecting member 8, which bridge the respective bottom connecting members 6 and the respective paired parallel back connecting members 2, provide sufficient strength to withstand against the twisting moment and firmly secure the structures (FIG. 6A).

As described above, after transporting the packing structure 1 with the outboard motor 11 to a given location, simply by disjointing parts of the rod members of the packing structure 1, the display stand 100 can be formed in which the outboard motor 11 is in the same position as when it is installed in a boat, thereby eliminating the need of a separate display stand, and eliminating the work of transferring the outboard motor 11 to a separate display stand.

Detaching Outboard Motor from Display Stand

When the outboard motor 11 is detached from the display stand 100, the process is very easy and simple. The crank bracket 110 of the outboard motor 11 is latched to the latch member 10 by fitting a concave portion of the crank bracket 110, whose concave surface faces down, into the latch member 10. FIG. 6 shows the processes of detaching an outboard motor 11 from the display stand 100. As shown in FIG. 6A which shows a connecting process of a hook of a lifting device, the cowling 12 is first taken off, and a hook 14 of a lifting device (not shown) is connected to a hook 13 of the head of the outboard motor 11. When lifting the outboard motor 11 from the position, the center of gravity 111 of the outboard motor 11 is slightly shifted to the side, thereby tilting the outboard motor 11, as shown in FIG. 6B which shows the commencement of lifting. From that position, when the outboard motor 11 is further lifted, the crank bracket 110 is automatically detached from the latch member 10, and the outboard motor 11 is detached from the display stand 100, as shown in FIG. 6C which shows a detaching process of the outboard motor from the display stand. Thus, when lifting the outboard motor 11, it is not necessary to support the display stand 100 in order to prevent the display stand from falling down.

In the present invention, no restrictions other than those recited in the claims are imposed. For example, in order to further reinforce the structures, additional rods or other members can be used, such as additional bridging rods and additional intersecting rods.

It will be understood by those of skill in the art that numerous variations and modifications can be made without departing from the spirit of the present invention. Therefore, it should be clearly understood that the forms of the present invention are illustrative only and are not intended to limit the scope of the present invention.

We claim:

1. An outboard motor packing structure convertible to a display stand, having an interior for accommodating an outboard motor, said interior formed in a rectangular parallelepiped formed with rod members, said rod members comprising:

paired parallel front members, each having a top end and a bottom end;

paired parallel back members, each having a top end and a bottom end;

top connecting members for connecting said top ends of said paired parallel front members and said paired parallel back members;

bottom connecting members for connecting said bottom ends of said paired parallel front members and said paired parallel back members;

a latching member for fastening a crank bracket of the outboard motor therein, said latching member perpendicularly bridging said paired parallel back members;

a first right-side connecting member having first and second ends for connecting one of said paired parallel back members at said first end and one of said respective paired parallel front members at said second end on the right side, said second end being detachable from said one of said paired parallel front members, wherein said side connecting member is pivotable at said first end, and said second end is fixedly connectable to one of said bottom connecting members on the right side; and a first left-side connecting member having first and second ends for connecting one of said paired parallel back members at said first end and one of said respective paired parallel front members at said second end on the left side, said second end being detachable from said one of said paired parallel front members, wherein said side connecting member is pivotable on said first end, and said second end is fixedly connectable to one of said bottom connecting members on the left side, wherein said rod members are coordinated in such a way that when the outboard motor is accommodated in the interior of said packing structure, the crank bracket of the outboard motor is latched onto said latching member, the top of the outboard motor faces said top connecting members, and said packing structure can be set up with the bottom connecting members down.

2. An outboard motor packing structure convertible to a display stand according to claim 1, further comprising:

a second right-side connecting member having first and second ends for connecting one of said paired parallel back members at said first end and one of said respective paired parallel from members at said second end on the right side, said second right-side connecting member and said first right-side connecting member being positioned in such a way that the distance between said second end of said first right-side connecting members and said second end of said second right-side connecting member is greater than the distance between said first end of said first right-side connecting members and said first end of said second right-side connecting member; and a second left-side connecting member having first and second ends for connecting one of said paired parallel back members at said first end and one of said respective paired parallel front members at said second end on the left side, said second left-side connecting member and said first left-side connecting member being positioned in such a way that the distance between said second end of said first left-side connecting members and said second end of said second left-side connecting member is greater than the distance between said first end of said first left-side connecting members and said first end of said second left-side connecting member.

3. An outboard motor packing structure convertible to a display stand according to claim 2, further comprising feet attached to the underside of said paired parallel bottom connecting members at the top and bottom ends and a midsection of said paired parallel bottom connecting members, wherein said foot at the midsection is positioned under said latch member, between said first ends of said first and second right-side connecting members and between said first ends of said first and second left-side connecting members.

4. An outboard motor packing structure convertible to a display stand according to claim 1, further comprising a fastening belt for fastening a lower end of the outboard motor, said belt being attached to at least one of said bottom connecting members, connecting said bottom ends of said paired parallel back members.

5. An outboard motor packing structure convertible to a display stand according to claim 1, wherein said top connecting members are comprised of two parallel pairs of members perpendicular to each other, and said bottom connecting members are comprised of two parallel pairs of members perpendicular to each other.

6. An outboard motor packing structure convertible to a display stand according to claim 1, wherein said latching member is positioned in such a way that when the outboard motor is accommodated in the interior of said packing structure, the outboard motor is vertically set up when said structure is set up with said bottom connecting members down.

* * * * *